United States Patent [19]

Kusuda

[11] Patent Number: 4,990,968

[45] Date of Patent: Feb. 5, 1991

[54] MULTI-COLORED IMAGE FORMING APPARATUS

[75] Inventor: Yasuhiro Kusuda, Osaka, Japan

[73] Assignee: Minolta Camera Kabushiki Kaisha, Osaka, Japan

[21] Appl. No.: 224,347

[22] Filed: Jul. 26, 1988

[30] Foreign Application Priority Data

Jul. 28, 1987 [JP] Japan ..... 62-189864

[51] Int. Cl.[5] ..... G03G 15/01

[52] U.S. Cl. ..... 355/326; 355/245; 355/327

[58] Field of Search ..... 355/7, 4, 14 D, 3 DD, 355/326, 327, 245, 251, 218, 208; 118/658; 430/45

[56] References Cited

U.S. PATENT DOCUMENTS

| | | | |
|---|---|---|---|
| 3,914,043 | 10/1975 | McVeigh | 355/326 |
| 4,045,218 | 8/1977 | McVeigh | 430/45 |
| 4,235,194 | 11/1980 | Wada et al. | 355/3 DD X |
| 4,338,880 | 7/1982 | Tabuchi et al. | 118/652 |
| 4,466,379 | 8/1984 | Nishimura | 118/658 |
| 4,591,261 | 5/1986 | Saruwatari et al. | 355/14 D X |
| 4,710,016 | 12/1987 | Waatanabe | 355/4 |
| 4,752,802 | 6/1988 | Ito et al. | 355/14 D X |
| 4,816,869 | 3/1989 | Kasai et al. | 355/326 X |

FOREIGN PATENT DOCUMENTS

| | | | |
|---|---|---|---|
| 0226364 | 12/1984 | Japan | 355/4 |
| 0142366 | 7/1985 | Japan | 355/4 |
| 61-93471 | 5/1986 | Japan . | |
| 0203474 | 9/1986 | Japan . | |

*Primary Examiner*—A. T. Grimley
*Assistant Examiner*—Robert Beatty
*Attorney, Agent, or Firm*—Burns, Doane, Swecker & Mathis

[57] ABSTRACT

A multi-colored image forming apparatus is capable of forming a copy image of an original document with different colors in designated edit areas. The apparatus has first and second developing devices each containing a developer material of different color and a control section for controlling the first and second developing devices in response to a developing switch signal generated with scanning of designated edit areas of the document. The developing devices have a sleeve to be rotated in a predetermined direction, a multi-pole magnetic roller disposed in the sleeve to be rotated in the same direction as the sleeve, a scraper member for scraping off developer material from the sleeves peripheral face and a feed device for feeding developer material to an upstream side of the scraper member relative to the rotational direction of the sleeve. The control section is operable to stop the rotation of the first actuated developing device's magnetic roller while maintaining the rotation of its sleeve in response to a developing switch signal. Thereafter, the second actuated developing device's magnetic roller is energized. By causing the sleeves of the developing devices to be rotated at different rates, the different color areas may be made to overlap or, alternatively, such overlapping may be minimized or avoided.

9 Claims, 10 Drawing Sheets

DRAFTSMAN SUBCLASS

MULTI-COLORED IMAGE FORMING APPARATUS

(1) FIELD OF THE INVENTION

The present invention relates to an apparatus for obtaining a multi-colored copy of an original document.

(2) DESCRIPTION OF THE PRIOR ART

An electrophotographic copier such as the foregoing type of multi-colored image forming apparatus is known, for example, from U.S. Pat. No. 3,914,043.

This copier includes, at a side of the upper document glass table of its body, area designating means operable to designate a plurality of areas on the document table face, the areas being divided in a scanning direction of an exposure lamp, the means being operable also to designate a copy color(s) of the document image being positioned within the designated areas.

For obtaining a two-color copy of a document with the above copier, first, the exposure lamp is activated for scanning the document to form an electrostatic latent image on an exterior circumferential face of a photoconductive drum. Second, while retaining part of the electrostatic latent image corresponding to a first designated area, the rest of the latent image is erased. Then, the remaining image is developed with a developer material of a first color designated for the first designated area. Thereafter, the developed image is transferred and fixed by thermal fusing to a copy sheet, whereby the first color copy image is obtained on the copy sheet.

Subsequently, the exposure lamp is again activated for scanning to form an electrostatic latent image. Then, while retaining part of the latent image corresponding to a second designated area, the rest of the image is erased. And, the latent image of the second designated area is developed with a developer material of a second designated color and this developed image is transferred and fixed onto the face of the copy sheet bearing the first color copy image. After this, the copy sheet is discharged from the copier body.

However, the above-described copier is inefficient since the problem remains that the copy run or cycle must be repeated a plurality of times corresponding to the desired number of copy colors.

As a result, copying operation takes a long time. The copy sheet will experience contraction by the heat in the fusing process of the first color image. Also, there tends to occur undesired overlapping of the first color image and the second color image because of possible error in positioning of the leading end of the sheet between the first copy cycle and the second copy cycle. Consequently, there will occur a quality defect in the copy with undesired overlapping or free space between the two color images.

SUMMARY OF THE INVENTION

With a view to the above-described state of the art, it is the primary object of the present invention to provide an improved multi-colored image forming apparatus comprising a plurality of developing means capable of obtaining a multi-colored copy of an original document by only one imaging cycle.

It is a further object of the present invention to provide an image forming apparatus of the above-noted type capable of producing a high-quality multi-colored image with clear inter-color distinction by reducing inadvertent mutual interference of the respective developing means.

In order to achieve the first-noted object, a multi-colored image forming apparatus related to the present invention comprises a document table, a photoconductive member, scanning means operable to scan an original document placed on the document table, means for forming an electrostatic latent image on the photoconductive member by projecting the image scanned by the scanning means onto the photoconductive member, first developing means operable to develop the electrostatic latent image on the photoconductive member with a developer material having an arbitrary color, the first developing means including a sleeve to be rotated in a predetermined direction, a multi-pole magnetic roller disposed in the sleeve to be rotated in the same direction therewith, a scraper member operable to scrape off developer material from a circumferential face of the sleeve, feed means for feeding developer material to an upstream side of the scraper member relative to the rotational direction of the sleeve, second developing means operable to develop the electrostatic latent image on the photoconductive member with a developer material having a further arbitrary color, the second developing means including, a sleeve to be rotated in a predetermined direction, a multi-pole magnetic roller disposed in the sleeve to be rotated in the same direction therewith, a scraper member operable to scrape off developer material from a circumferential face of the sleeve, feed means for feeding developer material to an upstream side of the scraper member relative to the rotational direction of the sleeve, designating means operable to designate at least one of plural areas of a scanning face scanned by the scanning means divided relative to its scanning direction, copy start means for providing a copy start command, means operable to detect arrival of the scanning means at the area designated by the designating means during scanning and to generate a developing switch signal, and control means for controlling image forming processes, the control means including a first control unit for energizing the scanning means, image forming means and the first developing means in response to the copy start command, and a second control unit operable, in response to the developing switch signal, to stop the rotation of the magnetic roller while maintaining the rotation of the sleeve of the first developing means thereby energizing the second developing means.

Referring here more particularly to a transport direction of the developer material on the sleeve during a developing process, the developer material fed by the feed means onto the sleeve is caused to be transported eventually in a direction opposite to the rotational direction of the sleeve because of the changing polarity associated with rotation of the magnetic roller.

With the multi-colored image forming apparatus having the above-described construction, the developer materials are instantaneously fed to or scraped off from the areas to be developed whereby the developing devices may be set ready for developing or set to a non-developing condition thereof very quickly.

As the result, the respective designated areas will be fed with the designated developer material only, whereby the obtained image will be of high-quality having no blurring or inadvertent overlapping of different colors.

The second-noted object of the present invention may be achieved by differentiating the rotational speeds of the sleeves of the first developing means and second developing means such that the former is faster than the latter.

This arrangement was achieved based on the following facts specified below as (a) and (b):

(a) If the rotational speed of the developer sleeve is increased, this results in longitudinal extention of a leading-edge region where image density increases from the start of the developing process to a predetermined value and results at the same time in longitudinal reduction of a trailing-edge region where reversely the image density decreases from the predetermined value to zero.

(b) If the rotational speed of the developer sleeve is reduced, the opposite is true. That is, the leading-edge region is longitudinally reduced while the trailing-edge region is longitudinally extended.

Further, according to one preferred embodiment of the present invention, in the art of designating a position where switching-over of two developing devices is to take place for changing colors, there is provided, in place of the prior art designation by ten keys, position designating means freely movable at least between a scanning start position and a scanning end position along the document table. This position designating means is operable to designate the developing switch position on the document table and to effect switching-over of the developing devices when the scanning means has reached this position designated by the position designating means.

Still a further object of the present invention is to provide an image forming apparatus of the above-noted type capable of controllably overlapping development areas of the respective developing means. Such overlapping may be achieved by differentiating the rotational speeds of the respective sleeves of the developing means opposite the manner previously described.

The foregoing and other objects, features and advantages of the invention will be apparent from the following more particular description of preferred embodiments of the invention, as illustrated in the accompanying drawings.

DESCRIPTION OF THE PREFERRED EMBODIMENTS

Preferred embodiments of the present invention will be particularly described hereinafter with reference to the accompanying drawings.

Figure 1:
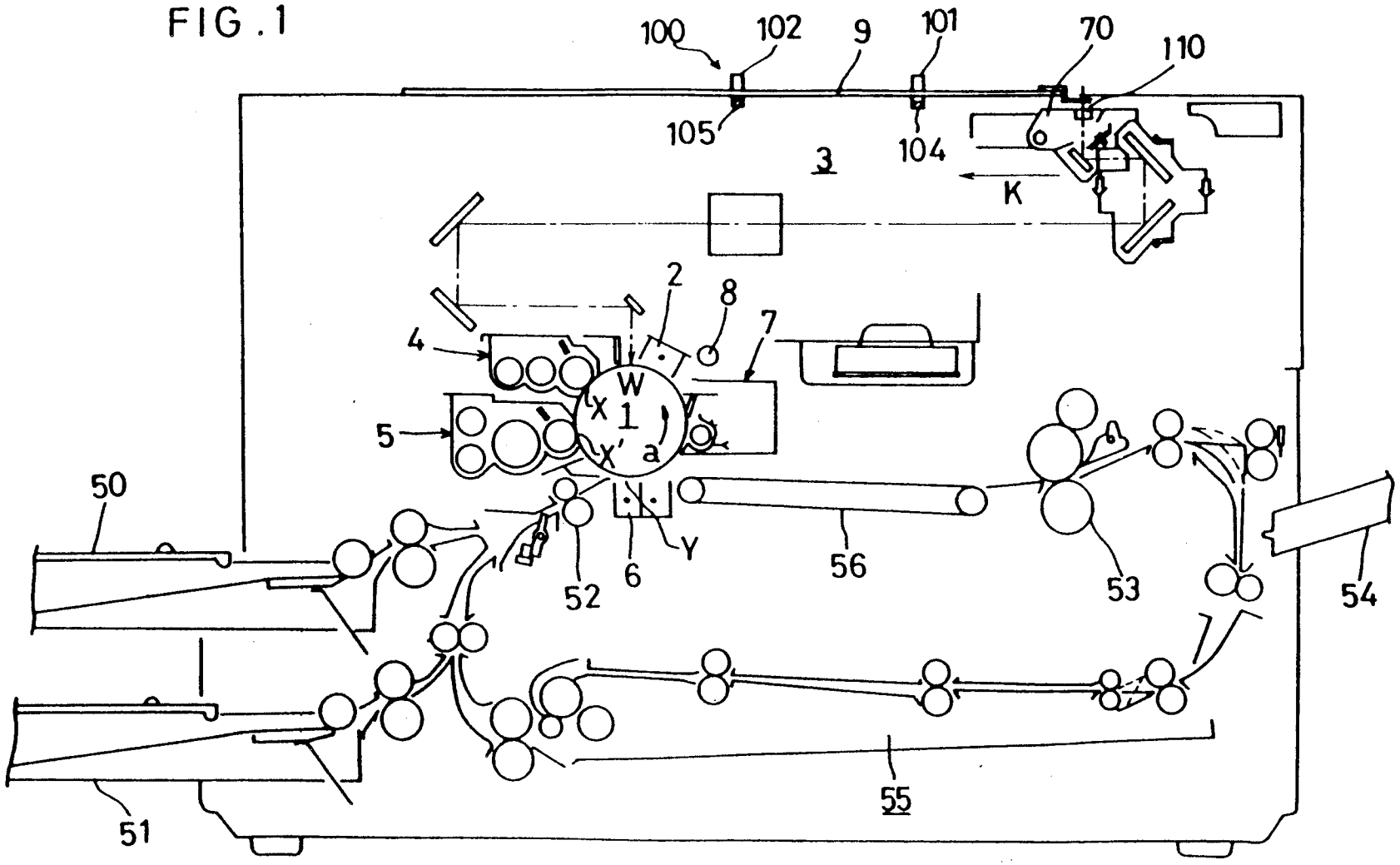
FIG. 1 is a section view showing an electrophotographic copier related to the present invention.

FIG. 1 is a section view showing schematic construction of a multi-colored copier representing a multi-colored image forming apparatus related to the present invention. A normal copying operation using this copier will be described next.

First, while being rotated in the direction of arrow a, a photoconductive drum 1 is charged by a corona charger 2 to a predetermined potential. In an optical unit 3, an unillustrated original document placed on a document table 9 is irradiated with a light beam. As this light beam reflected from the document is applied onto the above-noted charged surface of photoconductive drum 1, there is formed on this surface an electrostatic latent image of the original document. This electrostatic latent image is developed in a developing station X or X' to be a toner powder image with a developer, i.e. toner material supplied from a first developing device 4 or second developing device 5.

On the other hand, a copy sheet is selectively fed from a sheet feed unit 50 or 51, and the sheet is then transported by a timing roller 52 in synchronism with the toner powder image to a transfer station Y, where the powder image is transferred by charging of a transfer charger 6 onto the copy sheet.

This toner-image-bearing copy sheet is then transported by a conveyor belt 56 to a fusing device 53, where the toner image is substantially permanently fixed by fusion to the copy sheet. Thereafter, the copy sheet is discharged into a sheet discharge unit 54.

Concurrently with the above, the photoconductive drum 1, having passed the transfer station Y, has residual toner material remaining on the surface thereof scraped off by a cleaner device 7 and further the drum 1 has its residual charge erased by irradiation of an eraser lamp 8; then, the photoconductive drum 1 is ready for a next developing operation.

Incidentally, if a composite copy mode or a duplex copy mode is selected, the copy sheet having passed the fusing device 53 is transported to a duplex device 55, where, in the duplex copy mode, the copy sheet undergoes a face upside-down inversion by the duplex device 55 and then this inverted sheet is transported again to the transfer station Y to have its opposite side formed with a copy image. On the other hand, in the composite copy mode, the copy sheet is directly transported again without being inverted by the duplex device 55 to the transfer station Y where another image is formed by superposition on the same image face of the copy sheet.

Next, constructions of the first developing device 4 and second developing device 5 will be particularly described with reference to FIGS. 2 through 5.

These first and second developing devices 4 and 5 have the same construction. Inside a developing tank 11, there are disposed, from the side of the photoconductive drum 1, a developer sleeve 12, a first screw 19 and a second screw 20 in the mentioned order. The first developing device 4 accommodates therein a developer material including magnetic carrier and color toner; whereas, the second developing device 5 accommodates therein another developer material including the magnetic carrier and black toner.

The developer sleeve 12 comprises non-magnetic conductive material formed into a hollow cylinder including therein a multi-pole magnetic roller 16 incorporating a plurality of magnets interspaced radially of and extended axially of the roller 16. This magnetic roller 16, as shown particularly in FIG. 3, has its one support shaft end 17 thereof supported at a bearing recess 15 defined in the interior of the developer sleeve 12 and has its opposite support shaft end 18 thereof supported by a side wall of the developing tank 11, such that the magnetic roller 16 may be rotated by a drive mechanism 30 to be described later.

Figure 4:
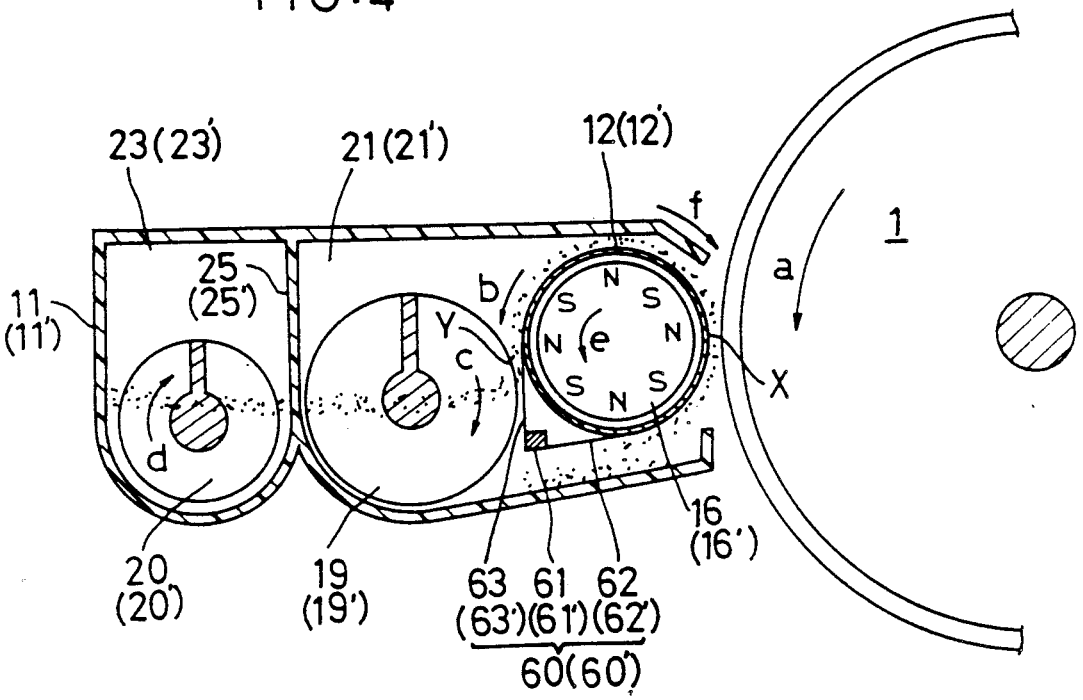
FIGS. 4 and 5 are cross sections of the developing devices.
Figure 5:
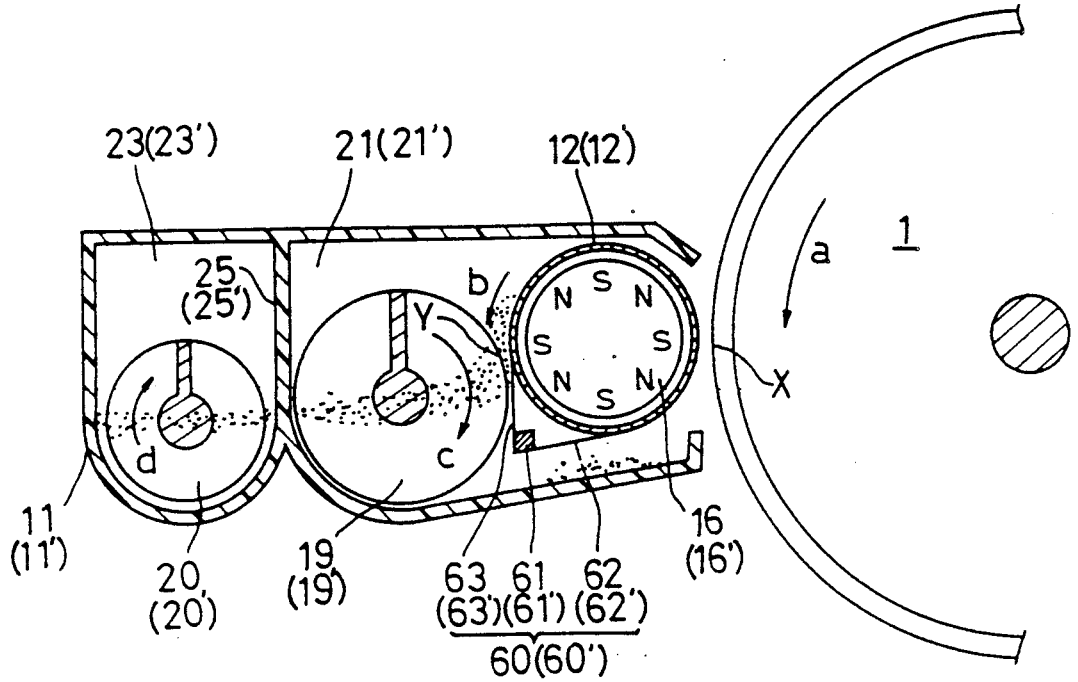

Rearwardly and downwardly of the developer sleeve 12, as shown in FIGS. 4 and 5, there is provided a developer material removing mechanism 60 for removing the developer material from the developer sleeve 12.

Referring to this developer material removing mechanism 60, a support member 61 is disposed in parallel with the developer sleeve 12 with its ends being secured to the side walls of the developing tank 11. This support member 61 carries a first scraper 62 and a second scraper 63, with a leading edge of the first scraper 62 being placed in pressure contact with a lower face of the developer sleeve 12 and with a leading edge of the second scraper 63 being placed in pressure contact with a portion of the developer sleeve 12 facing the first screw 19.

Figure 3:
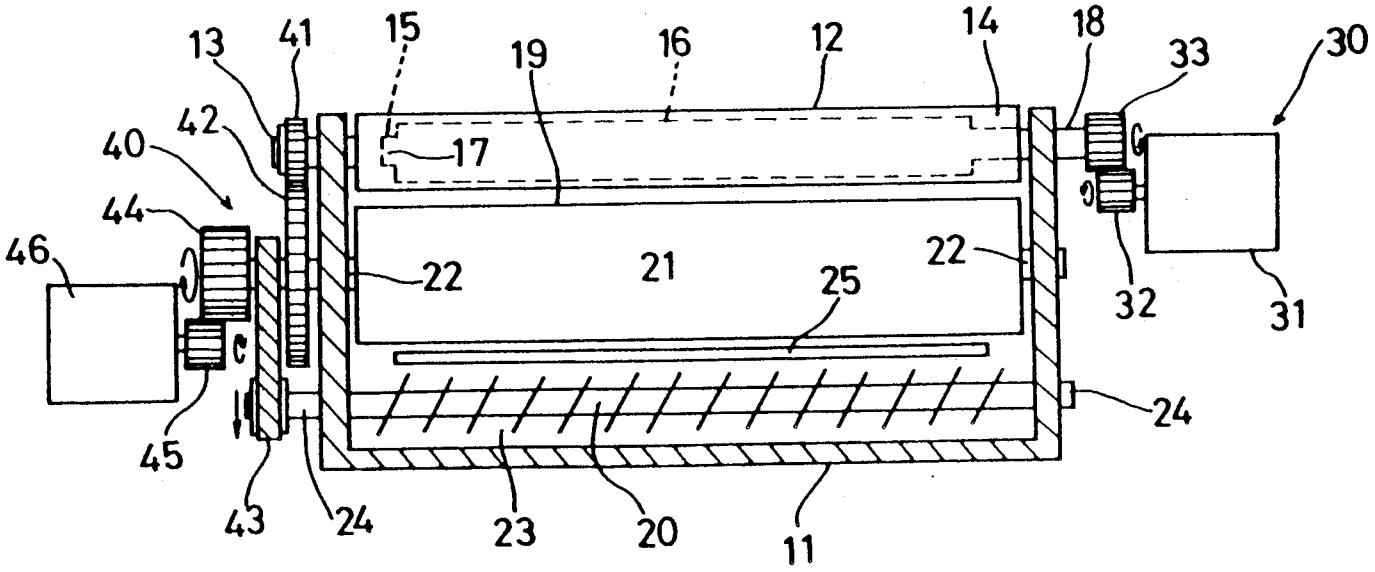
FIG. 3 is a vertical section showing developing devices.

The developer sleeve 12 has its bushing portion 14 shown on the right in FIG. 3 supported by a support shaft 18 of the magnetic roller 16 and has its opposite support shaft 13 supported by one of the side walls of the developing tank 11, such that the developer sleeve 12 is rotated by a drive mechanism 40.

The first screw 19 and the second screw 20 are disposed respectively in transport passages 21 and 23 partitioned by a partition wall 25 with their respective support shafts 22 and 24 being supported by the side walls of the developing tank 11 such that the screws 19 and 20 may be rotated by the drive mechanism 40.

Incidentally, as shown in FIG. 3, the transport passages 21 and 23 are communicated with each other at the front and rear sides in the developing tank 11.

Next, the drive mechanism 30 for the magnetic roller 16 and the drive mechanism 40 for the developer sleeve 12 and for the screws 19 and 20 will be described with reference to FIG. 3.

Figure 2:
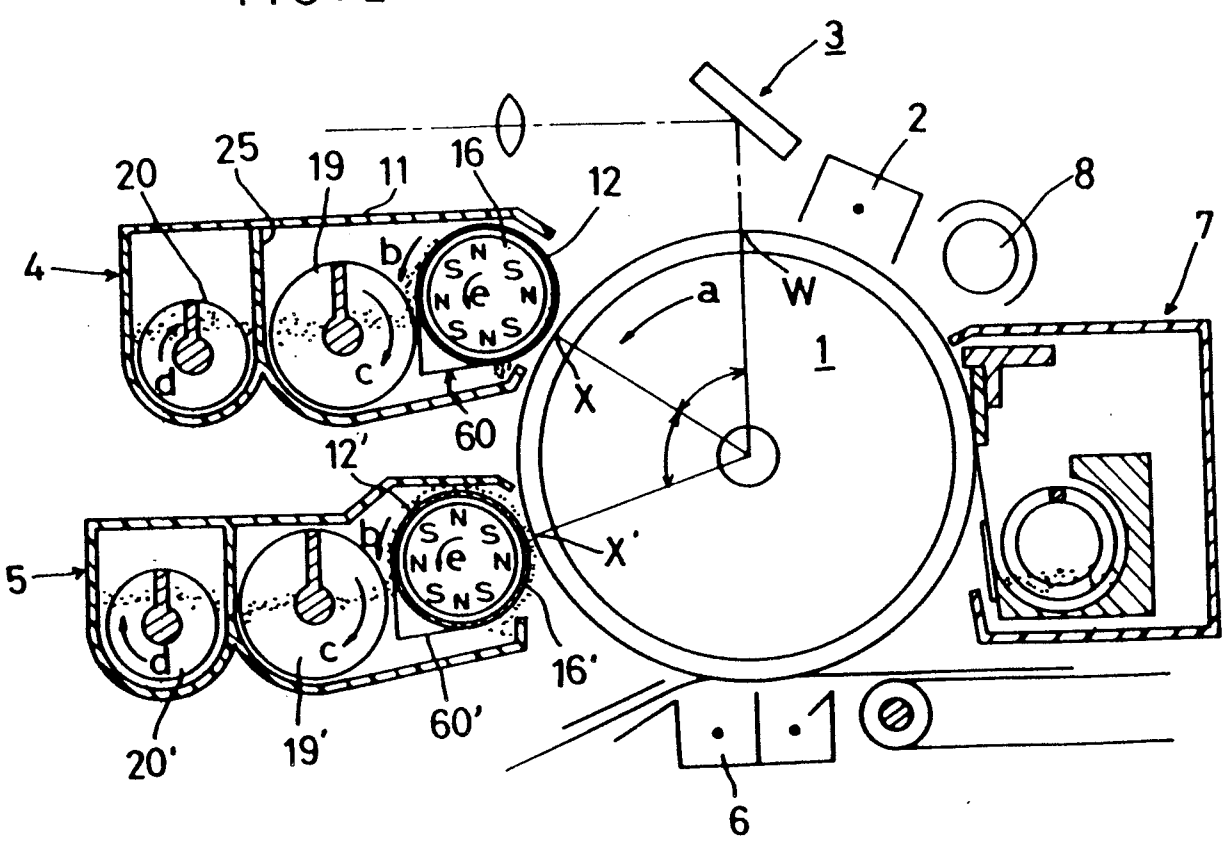
FIG. 2 is a section view showing a major portion of the copier.

In the drive mechanism 30, a gear 32 fitted on a drive shaft of a magnet drive motor 31 meshes with a gear 33 fitted on an end of the support shaft of the magnetic roller 16, such that the motor 31 drives the magnetic roller 16 to rotate at 1,500 rpm in the direction of arrow e (see FIG. 2).

In the drive mechanism 40, a gear 41 fitted on the support shaft 13 of the developer sleeve 12 meshes with a gear 42 fitted on the support shaft 22 of the first screw 19. Also, on the respective ends of the support shafts of the shaft 22 and second screw 20, there are fixedly fitted belt pulleys about which a belt 43 is entrained. Further, a gear 44 fitted on the support shaft end of the first screw 19 meshes with a gear 45 secured on a drive shaft of a sleeve drive motor 46.

In operation, with energization of this sleeve drive motor 46, as shown in FIG. 2, the developer sleeve 12 and the screws 19 and 20 are rotated in the directions of arrows b, c and d, respectively with the developer sleeve being rotated at 100 rpm.

As mentioned hereinbefore, the second developing device 5 has the same mechanism as the first developing device 4; therefore, in order to avoid redundency the second developing device 5 will not be described in detail. However, in order to facilitate reference to the elements of the first developing device, it is to be noted that the constituent elements of this second developing device 5 are denoted by reference numerals corresponding to those of the first developing device with a dash being attached thereto.

Next, there will be described functions and operations of an image edit mechanism 100 for forming a multi-colored copy image by selectively activating the first and second developing devices 4 and 5 during a single imaging process (this operation will be referred to as '1 shot 2 color copying' hereinafter).

Figure 6:
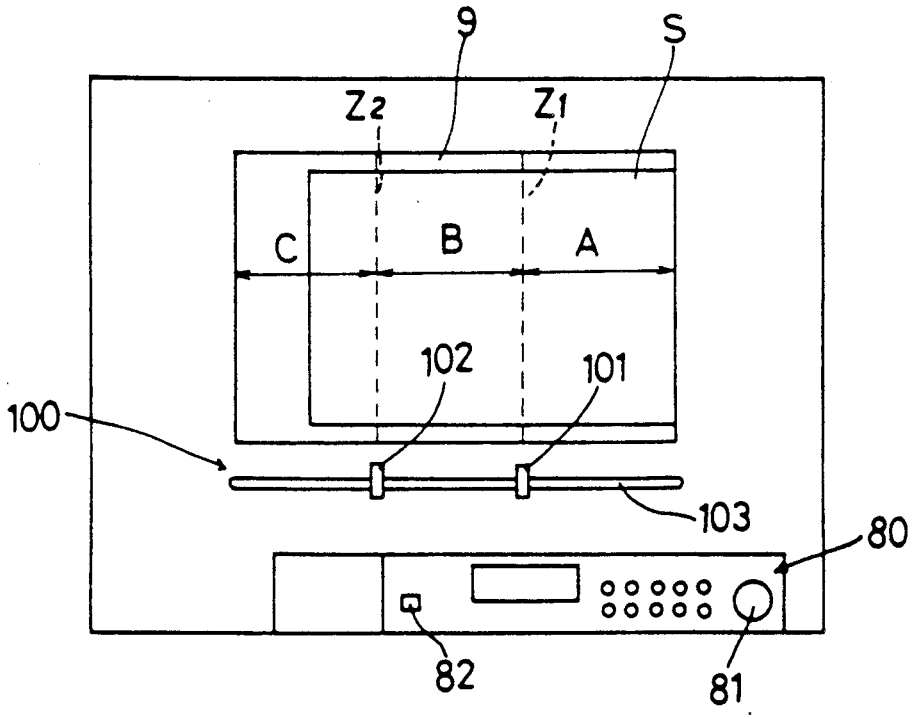
FIG. 6 is a plane view showing an image edit mechanism.
Figure 7:
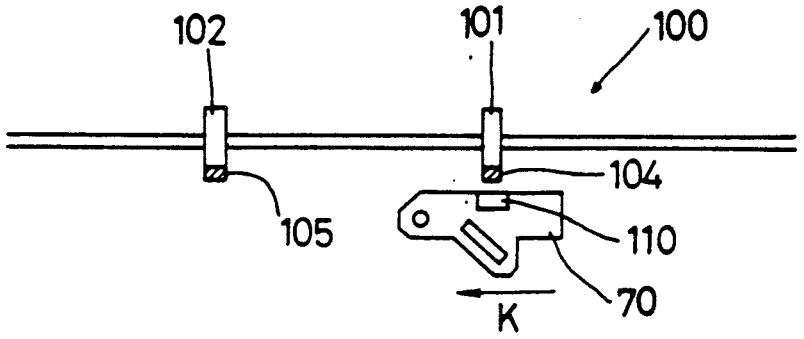
FIG. 7 is a section view of the image edit mechanism.

Referring now to FIG. 6, a guide groove 103 for the image edit mechanism 100 is defined before and in parallel with the document table 9. In this guide groove 103, there are attached levers 101 and 102 to be slidable along the groove 103. The levers 101 and 102 include magnets 104 and 105 at lower ends thereof positioned inside the copier body. On the other hand, a scanner 70 of the optical unit 3 carries a reed switch 110 operable to detect the magnets 104 and 105 with the scanner 70 scanning in the direction of arrow K and to generate detection signals to a control unit constituted mainly by a CPU 200.

In a copier control panel 80 illustrated in FIG. 6, a reference numeral 81 denotes a print key and numeral 82 denotes a 1 scan 2 color key, respectively.

Figure 8:
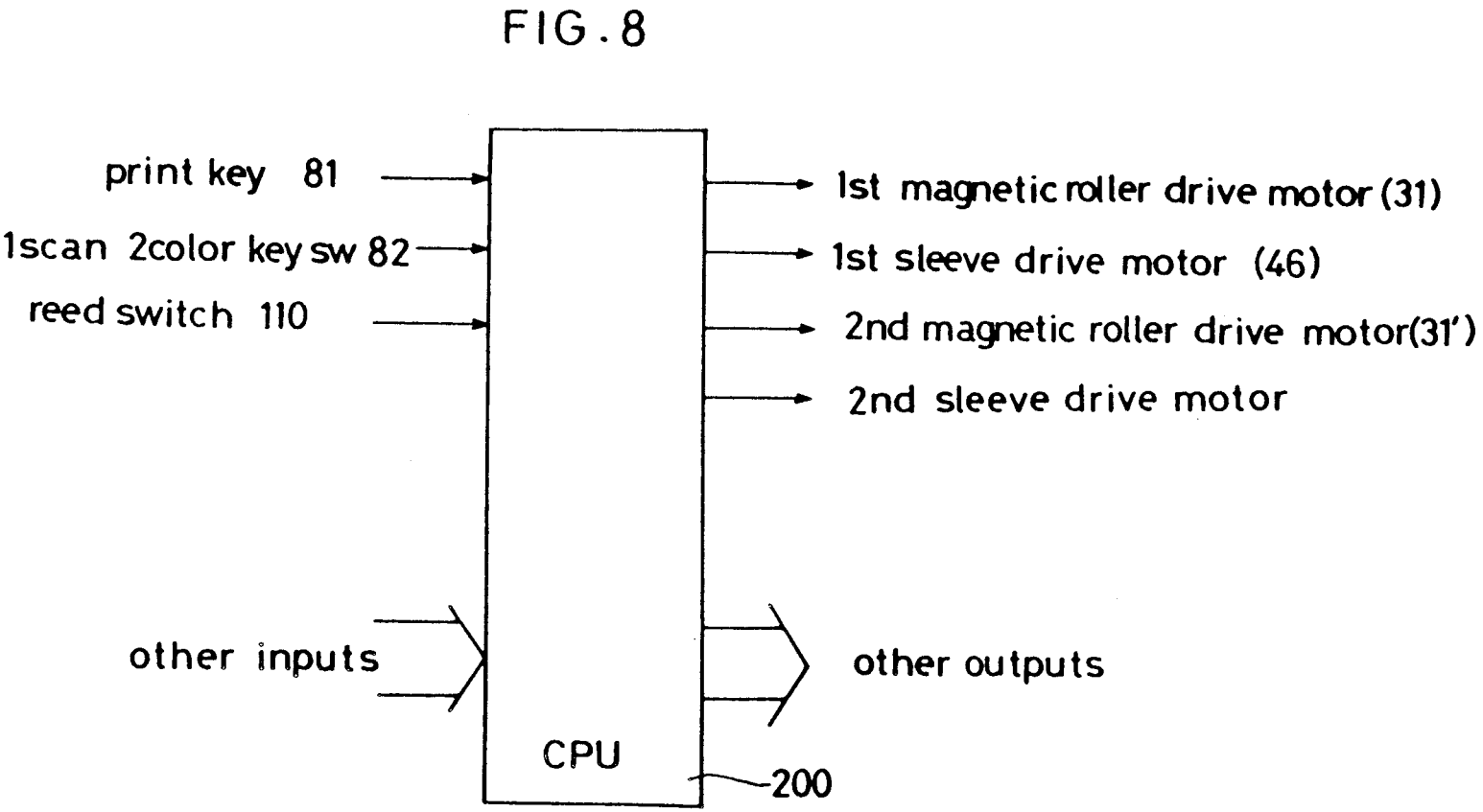
FIG. 8 is a diagram showing the input-output relationship in a central processing unit.

As apparent from FIG. 8, the CPU 200 of the control unit is operable to receive signals from the print key 81, the 1 scan 2 color key 82 as well as from the reed switch 110 and to generate control signals for the first magnetic roller drive motor 31, first sleeve drive motor 46, second magnetic roller drive motor 31', second sleeve drive motor 46' and so on.

Next, control operations by this control device for effecting 1 scan 2 color copying operation will be described with reference to a timing chart of FIG. 9.

Before describing this timing chart, the terms 'ON-EDGE' and 'OFF-EDGE' to be used hereinafter will be defined.

The term 'ON-EDGE' used here is to be understood to represent the change of condition of a switch, sensor, signal or the like from its 'OFF' to 'ON' state.

Whereas, the term 'OFF-EDGE' used here is to be understood to represent the change of condition of the same from its 'ON' to 'OFF' state.

First, with the switching ON of an unillustrated main or power switch, the copier is set to its initialized condition. Then, if the 1 scan 2 color key 82 is operated, the copying mode is set to 1 scan 2 color mode. Incidentally, this 1 scan 2 color key 82 is so designed that a copying operation will remain unaffected even if this key 82 is operated in the course of the copying operation.

Second, an original document S is placed on the document table 9 and the levers 101 and 102 are set as illustrated in FIG. 6. With this, the entire copying area corresponding to the document table 9 is divided into an edit area A extending from the leading edge of the document table 9 to the first lever 101, an edit area B extending from the first lever 101 to the second lever 102 and an edit area C extending from the second lever 102 to the rear edge of the document table 9, and the areas A and C are designated as black copy areas and the area B is designated as a color copy area, respectively.

With operation of the print key 81 and upon detection of its being ON-EDGE, in the second developing device 5 accommodating black toner material therein, as shown in FIG. 4, the motors 31' and 46' are driven respectively to rotate the developer sleeve 12' and magnetic roller 16' in the directions of arrows b and e (the same direction) and screws 19' and 20' are rotated in the directions c and d, respectively.

With the above, the developer material including the black toner accommodated in a developing tank 11', while being mixed and stirred by the rotation of screws 19' and 20', is circulated in transport passages 21' and 23', with a portion of the developer material being fed by the screw 19' in a toner feed region Y to the exterior circumferential face of the developer sleeve 12' thereby forming a magnetic brush thereon.

Incidentally, the developer material fed onto the developer sleeve 12' is subjected both to a transporting force in the direction b due to its frictional contact with the developer sleeve 12' and to another transporting force in a direction opposite to the rotational direction (direction of arrow e) due to the changing polarity associated with the rotation of magnetic roller 16'. However, since the rotational speed (1,500 rpm) of the magnetic roller 16' is designed to be considerably higher than that of the developer sleeve 12' (100 rpm), the transporting force of the magnetic roller 16' overrides that by the developer sleeve 12'. Accordingly, the developer material is transported in the direction of arrow f, and the developing device 5 is enabled for development.

When the developer material has reached the lower portion of the developer sleeve 12' after passing the portion facing the photoconductive drum 1, the developer material is scraped off by a first scraper 62'. This scraped-off developer material is then transported rearwardly by the effect associated with the rotation of screw 19' to be mixed with developer material being transported by this screw 19'.

On the other hand, in the first developing device 4, only the motor 46 is driven while maintaining the motor 31 de-energized, whereby the magnetic roller 16 is stopped and the developer sleeve 12 and the screws 19 and 20 are rotated in the directions b, c and d, respectively.

With the above, the developer material on the developer sleeve 12, as shown in FIG. 5, is transported in the direction of arrow b by the rotation of developer sleeve 12 and then scraped off from the surface of developer sleeve 12 by a second scraper 63 at the portion facing the screw 19 (feed area Y). Also, since the portion of developer material, which has been placed under the developer sleeve 12, is transported rearwardly by rotation of screw 19, there remains little developer material under the developer sleeve 12. Therefore, developer material will not be newly attached to the surface of the developer sleeve 12, and the first developing device 4 is set for the non-developing condition.

On the other hand, in the optical unit 3, the scanner 70 initiates scanning in the direction of arrow K to apply a light beam onto the document S placed on the document table 9, and the reflection of this light beam is applied from an exposure point W via a lens and a mirror onto the surface of photoconductive drum 1 charged to a predetermined potential. As a result, there is formed an electrostatic latent image corresponding to the document image on the surface of photoconductive drum 1. Subsequently, this electrostatic latent image is developed into a black copy image of the edit area A with supply of the black toner from the second developing device 5.

As the scanner 70 further moves in the direction of arrow K the reed switch 110 is turned ON as reaching the under-side of the magnet 104, which ON-EDGE condition is then detected. In this condition, the electrostatic latent image corresponding to a border Z1 between the edit areas A and B is positioned at the exposure point W. Therefore, after a time period: $T1-\delta1=t1$ measured by subtracting a time period $\delta1$ during which the developer material fed at the toner feed region Y is transported on the sleeve to a developing region X from a time period T1 during which the point on the photoconductive drum 1 arrives from the exposure point W at the developing region X, the motor 31 of the first developing device 4 is energized and the first developing device 4 is enabled for development. With this, developer material is transported on the developer sleeve 12 and a color development operation is initiated for the edit area B across the border Z1.

On the other hand, if a time period required for a point on the photoconductive drum 1 to move from the developing region X of the first developing device to the developing region X' of the second developing device is T2, in the second developing device 5, upon lapse of a time period t2 after the ON-EDGE detection, the motor 31' is de-energized for setting the developing device 5 for non-development condition and the developing operation with black toner for the edit area A is completed. Here, the time period t2 comprises $T1+T2-\delta2'$, i.e. the time period t2 obtained by subtracting the time period $\delta2'$ required for the point on the sleeve to move from the point scraped by the scraper 62' to the developing region X' from the sum of the time periods T1 and T2.

Thereafter, as the scanner 70 further moves in the direction of arrow K and the reed switch 110 detects the magnet 105 of the lever 102, after lapse of time period t3, the motor 31 is stopped, the first developing device 4 is set to the non-development condition and the color developing operation for the edit area B is completed. Here, the time period t3 comprises $T1-\delta2$, i.e. the time period t3 obtained by subtracting from the time period T1 the time period $\delta2$ required for the point on the sleeve to move from a point scraped by the scraper 62 to the developing region X. Then, upon lapse of the time period t4 measured after ON-EDGE detection of the reed switch 110, the motor 31' of the second developing device 5 is energized and the second developing device 5 is enabled for development to initiate developing operation with black toner for the edit area C across the border Z2. Here, the time period t4 comprises $T1+T2-\delta1'$, i.e. the time period t4 obtained by subtracting the timer period $\delta1'$ required for the fed developer material to be transported on the sleeve to the developing region X' from the sum of the time periods T1 and T2.

With the above-described processes, a two-colored image is obtained on the copy sheet with the areas A, C and area B of the original document S being reproduced in black and in color respectively.

A second preferred embodiment of the present invention will be described hereinafter.

The second-noted object of the present invention may be achieved by differentiating the rotational speeds of the sleeves of the first developing means and second developing means such that the former is faster than the latter.

This embodiment is characterized in that the sleeve 12 of the first developing device 4 is designed to have a rotational speed lower than that of the sleeve 12' of the second developing device 5. In this particular embodiment, the sleeve 12 has a rotational speed of 50 rpm while the sleeve 12' has a rotational speed of 200 rpm.

Figure 10:
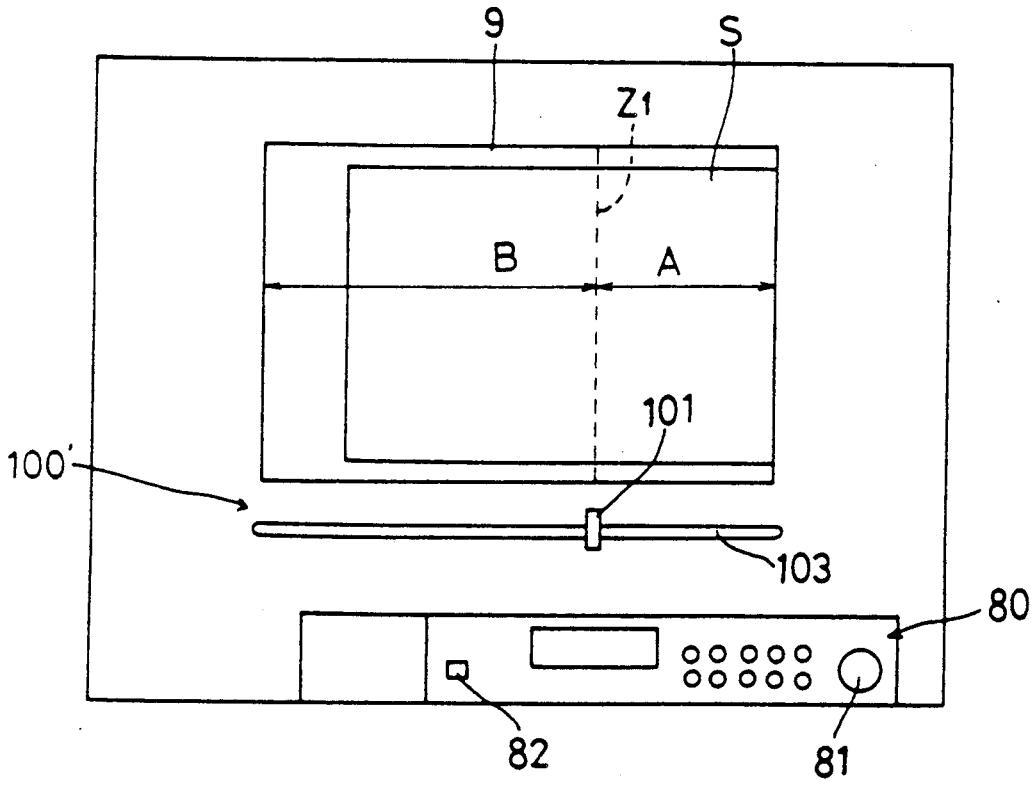
FIG. 10 is a plane view showing an image edit mechanism of a second embodiment.
Figure 11:
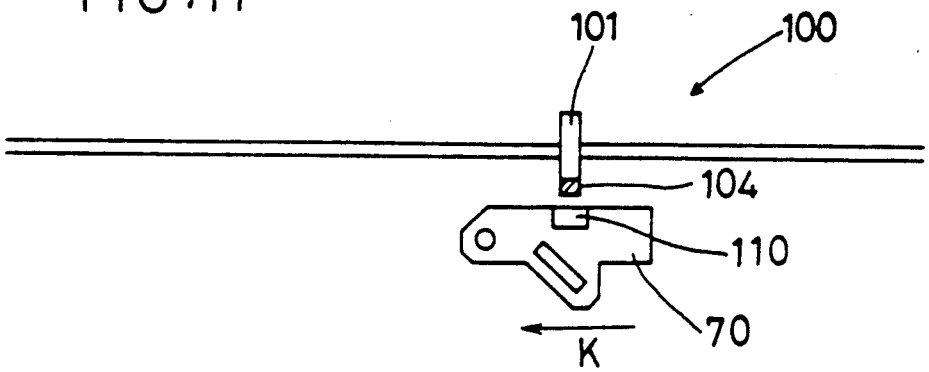
FIG. 11 is a section view of the image edit mechanism of FIG. 10, FIGS. 12 through 15 are graphs respectively illustrating various image-forming conditions.

An image edit mechanism 100' used in this embodiment, as shown in FIGS. 10 and 11, has substantially the same construction as that used in the previous embodiment except that there is attached only one lever 101 in the guide groove 103 in this mechanism. The rest of the construction is the same; therefore, the other elements having the same functions are denoted by the same reference marks and will not be described repeatedly. In the illustrated condition, the entire area of the document table 9 is divided into the edit area A extending from the leading edge of the document table 9 to the first lever 101, and an edit area B extending from the first lever 101 to the rear edge of the document table 9 with the area A being designated as a black copy area and area B being designated as a color copy area.

If the print key 81 is operated in this condition, a two-color copy of the document is obtained in the same manner as in the previous embodiment. However, the aforementioned arrangement of differentiated rotational speeds of the sleeves achieves effects to be described next.

Figure 12:
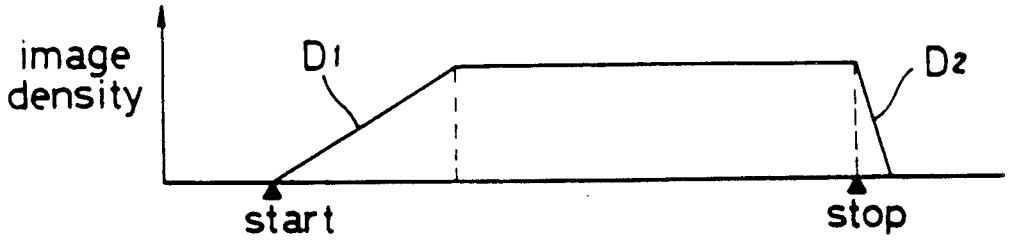

First, if the rotational speed of the developer sleeve 12' is increased, this results in longitudinal extention of a leading-edge region D1 where image density increases from the start of the developing process to a predetermined value and results at the same time in longitudinal reduction of a trailing-edge region D2 where reversely the image density decreases from the predetermined value to zero as shown in FIG. 12 because the transporting force by the developing sleeve 12' increases.

Figure 13:
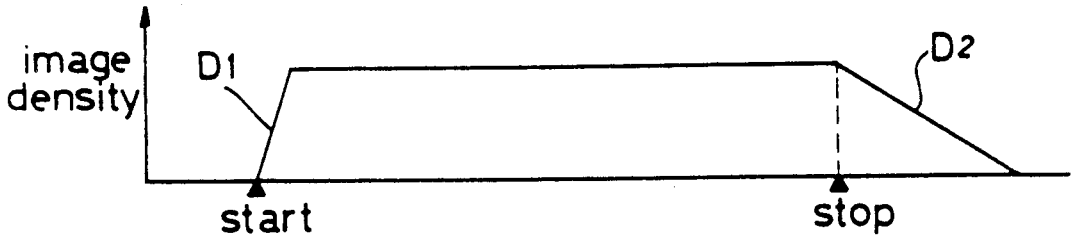
Figure 14:
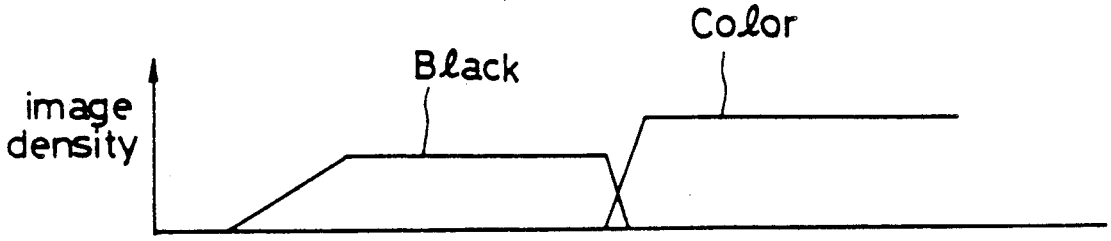

On the other hand, if the rotational speed of the developer sleeve 12 is reduced, the opposite is true. That is, the leading-edge region D1 is longitudinally reduced while the trailing-edge region D2 is longitudinally extended as shown in FIG. 13.

Because of the above facts, in the case where the rotational speed of the developer sleeve of the second developing device 5 is set to be higher than that of the first developing device 4, it becomes possible to achieve the effect of clear inter-color distinction in the vicinity of the border Z1.

Figure 9:
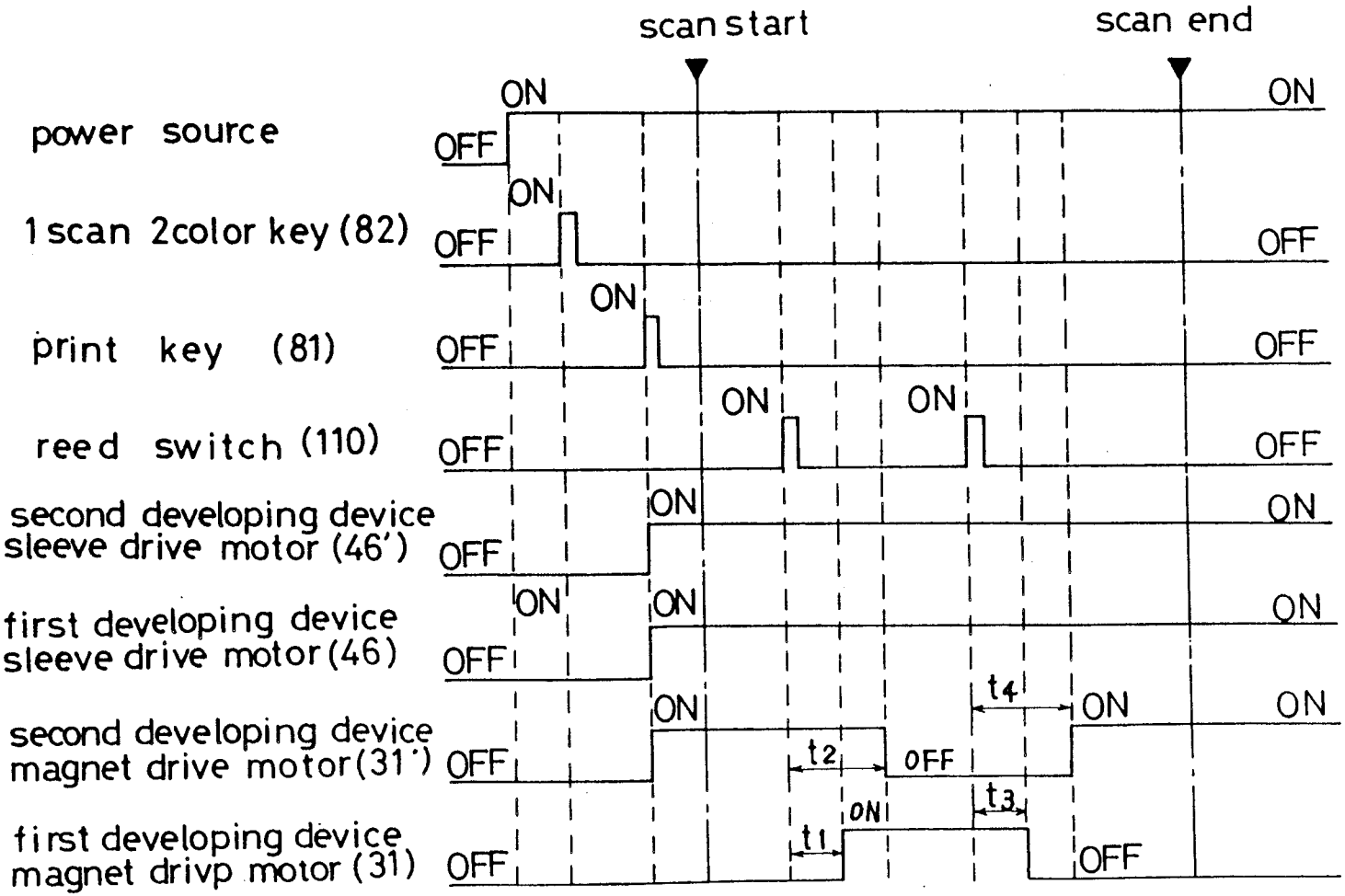
FIG. 9 is a timing chart illustrating timing control of the copier.
Figure 16:
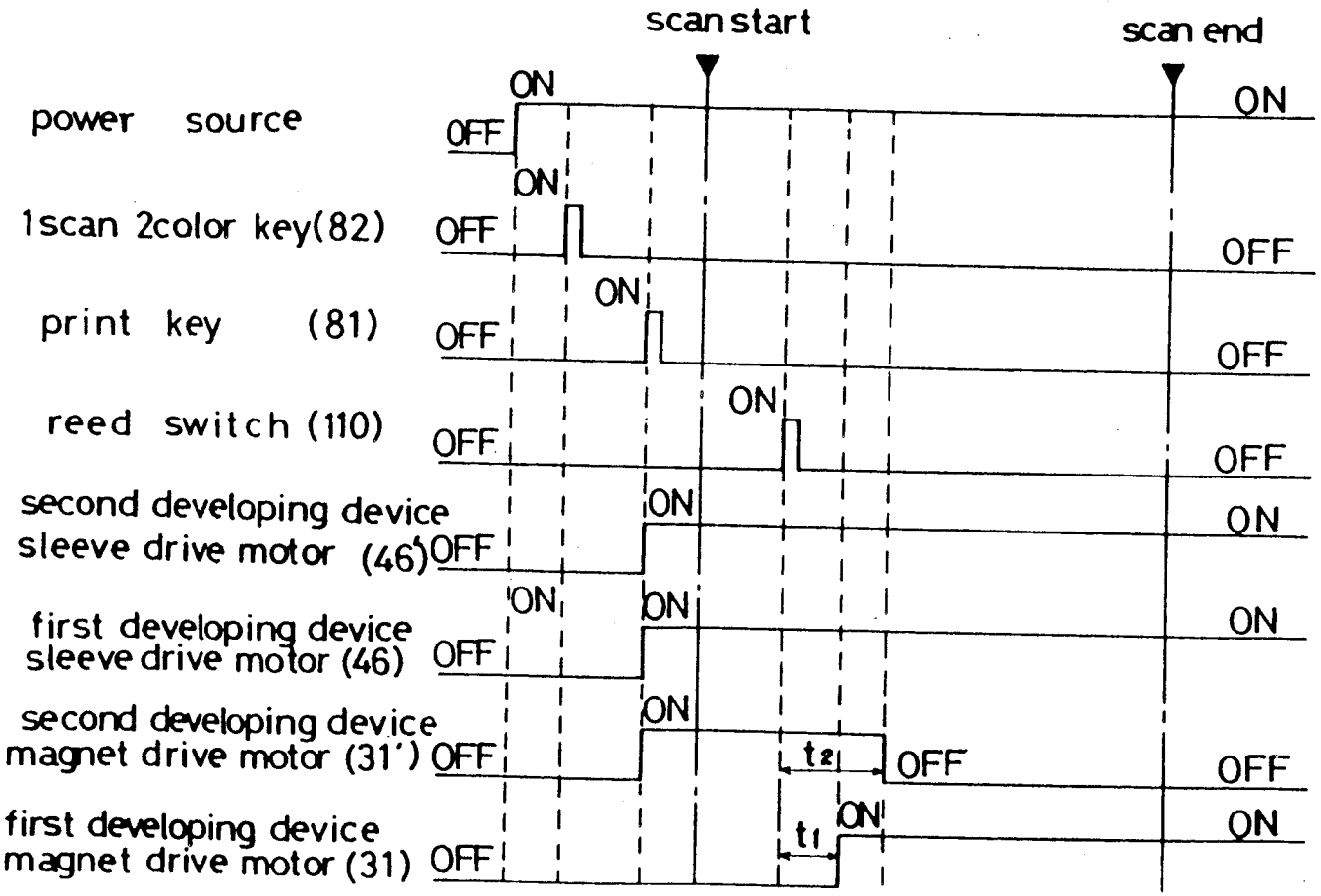
FIG. 16 is a timing chart illustrating timing control of the second embodiment.

The control operations of the copier of this second embodiment are effected as illustrated in a timing chart of FIG. 16, which will be readily understood as being similar to the timing chart of FIG. 9 of the previous embodiment.

That is, with operation of the print key 81, the sleeve drive motor 46 for the first developing device, sleeve drive motor 46' for the second developing device and the magnet drive motor 31' are energized thereby enabling the second developing device 5.

Then, with turning-ON of the reed switch 110, after lapse of the above-described time period t1, the magnet drive motor 31 of the first developing device is energized and then the magnet drive motor 31' of the second developing device is de-energized after lapse of the above-described time period t2, the second developing device thereby being set to the non-development condition while the first developing device is set to development condition. With this, the copier is ready for a two-color copying operation.

Figure 15:
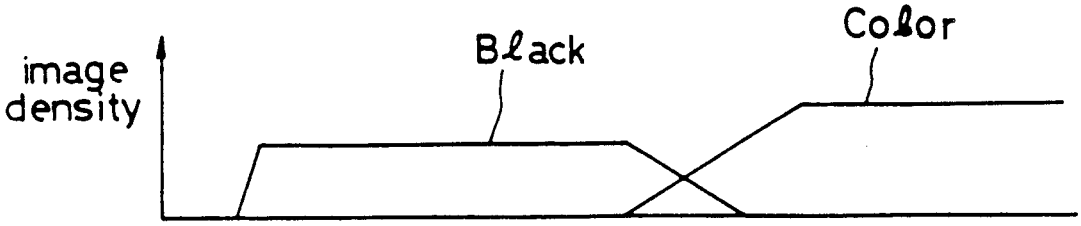

Also, as shown in FIG. 15, if the rotational speed of the first developing device 4 is set to be faster than that of the second developing device 5, it becomes possible to intentionally mix the copy colors in the vicinity of the border Z1.

Furthermore, in the present invention, an image edit mechanism having a plurality of input keys can be used instead of the image edit mechanism of the above embodiment.

What is claimed is:

1. A multi-colored image forming apparatus comprising:

a document table;

a photoconductive member;

electrostatic latent image forming means for forming an electrostatic latent image on said photoconductive member;

first developing means for developing the electrostatic latent image on said photoconductive member with a developer material having a color, said first developing means including, a sleeve to be rotated in a predetermined direction, a multi-pole magnetic roller disposed in said sleeve to be rotated in the same direction therewith, a scraper member operable to scrape off developer material from a circumferential face of said sleeve, feed means for feeding developer material to an upstream side of said scraper member relative to the rotational direction of said sleeve, second developing means for developing the electrostatic latent image on said photoconductive member with a developer material having another color, said second developing means including, a sleeve to be rotated in a predetermined direction, a multi-pole magnetic roller disposed in said sleeve to be rotated in the same direction therewith, a scraper member operable to scrape off developer material from a circumferential face of said sleeve, feed means for feeding developer material to an upstream side of said scraper member relative to the rotational direction of said sleeve, developing switch signal generating means for generating a signal for switching operation of said first and second developing means;

copy start means for providing a copy start command;

control means for controlling imaging processes, said control means including, a first control unit for energizing said image forming means and said first developing means in response to the copy start command, a second control unit operable, in response to the developing switch signal, to stop the rotation of said magnetic roller while maintaining the rotation of said sleeve of said first developing means and to energize said second developing means so that said second developing means develops a trailing end portion of the area which has been developed by said first developing means.

2. A multi-colored image forming apparatus as defined in claim 1, wherein said control means initiates rotation of said sleeve of the second developing means in response to the copy start command and initiates rotation of said magnetic roller of the second developing means in response to the development switch signal.

3. A multi-colored image forming apparatus as defined in claim 1, wherein a rotational speed of the sleeve of the first developing means is slower than that of the sleeve of the second developing means.

4. A multi-colored image forming apparatus comprising:

a document table;

a photoconductive member;

scanning means for scanning an original document placed on said document table from a scanning start position to a scanning end position;

means for forming an electrostatic latent image on said photoconductive member by projecting the image scanned by said scanning means onto said photoconductive member;

first developing means for developing the electrostatic latent image on said photoconductive member with a developer material having a color, said first developing means including, a sleeve to be rotated in a predetermined direction, a multi-pole magnetic roller disposed in said sleeve to be rotated in the same direction therewith, a scraper member operable to scrape off developer material from a circumferential face of said sleeve, feed means for feeding developer material to an upstream side of said scraper member relative to the rotational direction of said sleeve, second developing means operable for developing the electrostatic latent image on said photoconductive member with a developer material having another color, said second developing means including, a sleeve to be rotated in a predetermined direction, a multi-pole magnetic roller disposed in said sleeve to be rotated in the same direction therewith, a scraper member operable to scrape off developer material from a circumferential face of said sleeve, feed means for feeding developer material to an upstream side of said scraper member relative to the rotational direction of said sleeve, position designating means movable along said document table at least between the scanning start position and the scanning end position;

copy start means for providing a copy start command;

means for detecting arrival of said scanning means at the point designated by said designating means during scanning and to generate a developing switch signal;

control means for controlling image forming processes, said control means including, a first control unit for energizing said scanning means, image forming means and said first developing means in response to the copy start command, a second control unit operable, in response to the developing switch signal, to stop the rotation of said magnetic roller while maintaining the rotation of said sleeve of said first developing means and to energize said second developing means so that said second developing means develops a trailing end portion of the area which has been developed by said first developing means.

5. A multi-colored image forming apparatus as defined in claim 4, wherein said control means initiates rotation of said sleeve of the second developing means in response to the copy start command and initiates rotation of said magnetic roller of the second developing means in response to the development switch signal.

6. A multi-colored image forming apparatus as defined in claim 4, wherein a rotational speed of the sleeve of the first developing means is slower than that of the sleeve of the second developing means.

7. A multi-colored image forming apparatus with a plurality of developing units having different colored developers, said multi-colored image forming apparatus comprising:

a photoconductive member;

electrostatic latent image forming means for forming an electrostatic latent image on the surface of the photoconductive member;

first and second developing units for developing the electrostatic latent image formed on the photoconductive member, each of said first and second developing units including a rotatable sleeve, a multipole magnetic member rotatably provided in said sleeve and a scraper means for scraping the developer material from the peripheral surface of the sleeve;

developing switch signal generating means for generating a signal for switching operation of said first and second developing units;

first drive means for rotating the sleeve of the first developing unit;

second drive means for rotating the sleeve of the second developing unit, wherein the rotational speed of the sleeve of the second developing unit is lower than that of the sleeve of the first developing unit;

third drive means for rotating the magnetic member of the first developing unit in the same direction as the sleeve of the first developing unit;

fourth drive means for rotating the magnetic member of the second developing unit in the same direction as the sleeve of the second developing unit;

first control means for controlling said third drive means to stop the rotation of the magnetic member of the first developing unit in response to the developing switch signal; and second control means for controlling said fourth drive means to start the rotation of the magnetic member of the second developing unit in response to the developing switch signal.

8. A multi-colored image forming apparatus as defined in claim 7, further comprising:

start signal generating means for generating a start signal to start image forming operation; and third control means, in response to the start signal, for controlling said first drive means and said second drive means to start the rotation of the sleeves and for controlling said third drive means to start the rotation of the magnetic member.

9. A multi-colored image forming apparatus with a plurality of developing units having different colored developers, said multi-colored image forming apparatus comprising;

a document table on which an original document is placed;

a photoconductive member;

scanning means for scanning the original document from a scanning start position to a scanning end position;

means for forming an electrostatic latent image on the photoconductive member by projecting the image scanned by said scanning means onto the photoconductive member;

first and second developing units for developing the electrostatic latent image formed on the photoconductive member, each of said first and second developing units including a rotatable sleeve, a multipole magnetic member rotatably provided in said sleeve and a scraper means for scraping the developer material from the peripheral surface of the sleeve;

position designating means movable along the document table at least between the scanning start position and the scanning end position;

means for detecting arrival of said scanning means at the point designated by said designating means during scanning and for generating developing switch signal;

first drive means for rotating the sleeve of the first developing unit;

second drive means for rotating the sleeve of the second developing unit, wherein the rotational speed of the sleeve of the second developing unit is lower than that of the sleeve of the first developing unit;

third drive means for rotating the magnetic member of the first developing unit in the same direction as the sleeve of the first developing unit;

fourth drive means for rotating the magnetic member of the second developing unit in the same direction as the sleeve of the second developing unit;

first control means for controlling said third drive means to stop the rotation of the magnetic member of the first developing unit in response to the developing switch signal; and second control means for controlling said fourth drive means to start the rotation of the magnetic member of the second developing unit in response to the developing switch signal.

* * * * *